US006738036B2

(12) United States Patent
Janssen et al.

(10) Patent No.: US 6,738,036 B2
(45) Date of Patent: May 18, 2004

(54) DECODER BASED ROW ADDRESSING CIRCUITRY WITH PRE-WRITES

(75) Inventors: Peter J. Janssen, Scarborough (NL); Lucian Remus Albu, New York, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 158 days.

(21) Appl. No.: 09/920,826

(22) Filed: Aug. 3, 2001

(65) Prior Publication Data

US 2003/0025665 A1 Feb. 6, 2003

(51) Int. Cl.[7] ..... G09G 3/36

(52) U.S. Cl. ..... 345/87; 345/87; 345/88; 345/92; 345/97; 345/100; 345/204; 345/214

(58) Field of Search ..... 345/87–88, 92, 345/97, 100, 204, 214

(56) References Cited

U.S. PATENT DOCUMENTS 5,535,167 A * 7/1996 Hazani ..... 365/218
5,831,986 A * 11/1998 Sachdev ..... 714/719
6,107,979 A * 8/2000 Chiu et al. ..... 345/84
6,275,202 B1 * 8/2001 Campbell ..... 345/55
6,281,870 B1 * 8/2001 Hayashi ..... 345/100

FOREIGN PATENT DOCUMENTS

JP 06-149656 * 5/1994
JP 2000-25870 * 9/2000

* cited by examiner

*Primary Examiner*—Vijay Shankar
*Assistant Examiner*—Leonid Shapiro

(57) ABSTRACT

Row addressing circuitry for implementing random row selection, pre-writes, and bi-directional scrolling includes a plurality of decoders, each connected to an address bus, each having a decoder enable input, and each producing row enable signals for rows of a pixel array. Row enable information for each row from each decoder is logically combined together to produce composite row drive information. Beneficially, each decoder is connected to the same address bus, and each decoder enable signal is produced from a common controller. By using the row enable signals, in synchronization with address information on the address bus, the correct row drive information, such as pre-writes or image information, is applied to each of pixels. Bi-directional scrolling can be implemented by enabling two rows to accept the same image information.

11 Claims, 1 Drawing Sheet

DECODER BASED ROW ADDRESSING CIRCUITRY WITH PRE-WRITES

BACKGROUND OF THE INVENTION

1. Field of the Invention

This invention relates to electro-optic color display systems. More particularly, it relates to electro-optic color display systems with decoders that implement bi-directional row scanning and pre-writing.

2. Discussion of the Related Art

Display systems having colored light bars that sequentially scroll across an electro-optic light panel to produce a color image are well known. Such display systems are particularly useful for displaying color images that are continuously updated by frames, such as in color televisions. Typically, each frame is composed of color sub-frames, usually red, green and blue sub-frames.

Such display systems employ an electro-optic light panel that is comprised of individual pixel elements that are organized in a matrix of rows and columns. The individual pixels elements are modulated in accordance with pixel image information. Typically, the pixel image information is applied to the individual pixel elements by rows during each frame period. Such a matrix array of pixel elements is preferably "active" in that each pixel element is connected to an active switching element of a matrix array of switching elements.

Because each color sub-frame must be addressed during each frame period, the sub-frame addressing rate is three times faster than the frame rate. At present, a preferred electro-optic light panel is a reflective active-matrix liquid crystal display (AMLCD) that is produced on a silicon substrate and that employs a twisted nematic (TN) effect liquid crystal. Thin film transistors (TFTs) are usually used as the active switching elements. Such panels can support a high pixel density because the TFTs and their interconnections can be integrated onto the silicon substrate. Moreover, reflective active-matrix liquid crystal displays can be addressed at a much higher rate than transmissive active-matrix liquid crystal displays. However, a TN reflective active-matrix liquid crystal display requires about 100 microseconds to image a pixel element. In contrast, a row of pixel image information can be produced and applied to the pixel elements in about 5 microseconds. Another problem with current reflective TN active-matrix liquid crystal displays is that the pixel capacitance varies according to the applied voltage.

One problem with taking a relatively long time to image a pixel element is that the image accuracy of the pixel depends on that pixel's residual state, which in turn depends on previously imaged information. This means that the brightness of a particular pixel depends on the brightness of the previous image displayed by that pixel. Two-dimensional look-up tables can be used to provide correction values for new pixel image to correct for residual states.

The problems of slow response time and varying pixel capacitance versus voltage in reflective TN active-matrix liquid crystal displays can be reduced by using an electro-optic material having a faster response time and a reduced voltage-dependent capacitance. One class of such materials is the ferroelectric LC. However, ferroelectric LC materials have a memory effect in that the image that was produced (the prior image) must be overcome by a new image. Auxiliary "blanking pulses" that reset the pixels prior to imaging new pixels can significantly reduce the memory effect problem. Such blanking pulses can be applied during a line selection period via row electrodes in combination with a common counter-electrode. In practice, the use of two "pre-write" blanking pulses has proven more successful than using a single "pre-write" blanking pulse.

Pre-write blanking schemes usually require special circuitry for generating the blanking pulses. In the prior art, that special circuitry was not readily integrated into the driver circuitry that converted incoming pixel information, which is usually digital, into analog signals suitable for driving the active-matrix liquid crystal display.

Prior art circuitry for driving active-matrix liquid crystal displays usually used shift registers. However, in scrolling color applications (such as with a computer display screen), non-contiguous rows sometimes need to be accessed. Thus, multiple shift registers, operating in parallel, are required. Furthermore, if bi-directional scanning is desired, even more dedicated shift registers are required.

A known alternative to shift registers in some applications is the decoder. Decoders can enable random row selections. However, prior attempts to use decoders for presenting row information, producing pre-writes to compensate for memory effects, and to implement bi-directional scrolling proved impractical. Therefore, a new technique of using decoders to address rows (or columns) of a display device would be useful. Even more beneficial would be a new technique of using decoders to implement random row (or column) selection, pre-writes, and bi-directional scrolling of display devices.

SUMMARY OF THE INVENTION

The principles of the present invention provide a new technique of using decoders to implement random row (or column) selection and pre-writes in a display. Those principles can further enable bi-directional scrolling.

Drive circuitry according to the principles of the present invention can operate an electro-optic display device such that color artifacts caused by residual states are reduced or eliminated by pre-write blanking pulses. That drive circuitry can also implement bi-directional scrolling. Such drive circuitry includes a plurality of decoders, each connected to an address bus, each having a row select enable, and each producing a row select signal for a row of a pixel array. Select signals from the various decoders are combined for each pixel in the pixel array row together to produce pixel drive information for a pixel driver. Beneficially, each decoder is connected to the same address bus, and each row select enable signal is produced by a common controller. By using the row select enable lines, in synchronization with address information on the address bus, the correct pre-writes and image information is applied to a pixel driver for each row of pixels.

In accordance with the principles of the present invention, color artifacts caused by the residual states of the pixels in an electro-optic display device from previously addressed data signals are substantially reduced or eliminated by signals from at least one of the plurality of decoders, while image information is produced by another of the plurality of decoders.

Preferably, the common controller enables the decoders, as required, to produce a desired image, to pre-write row of pixels to prepare for the next image, and to enable bi-directional scanning.

DESCRIPTION OF THE PREFERRED EMBODIMENTS

Figure 1:
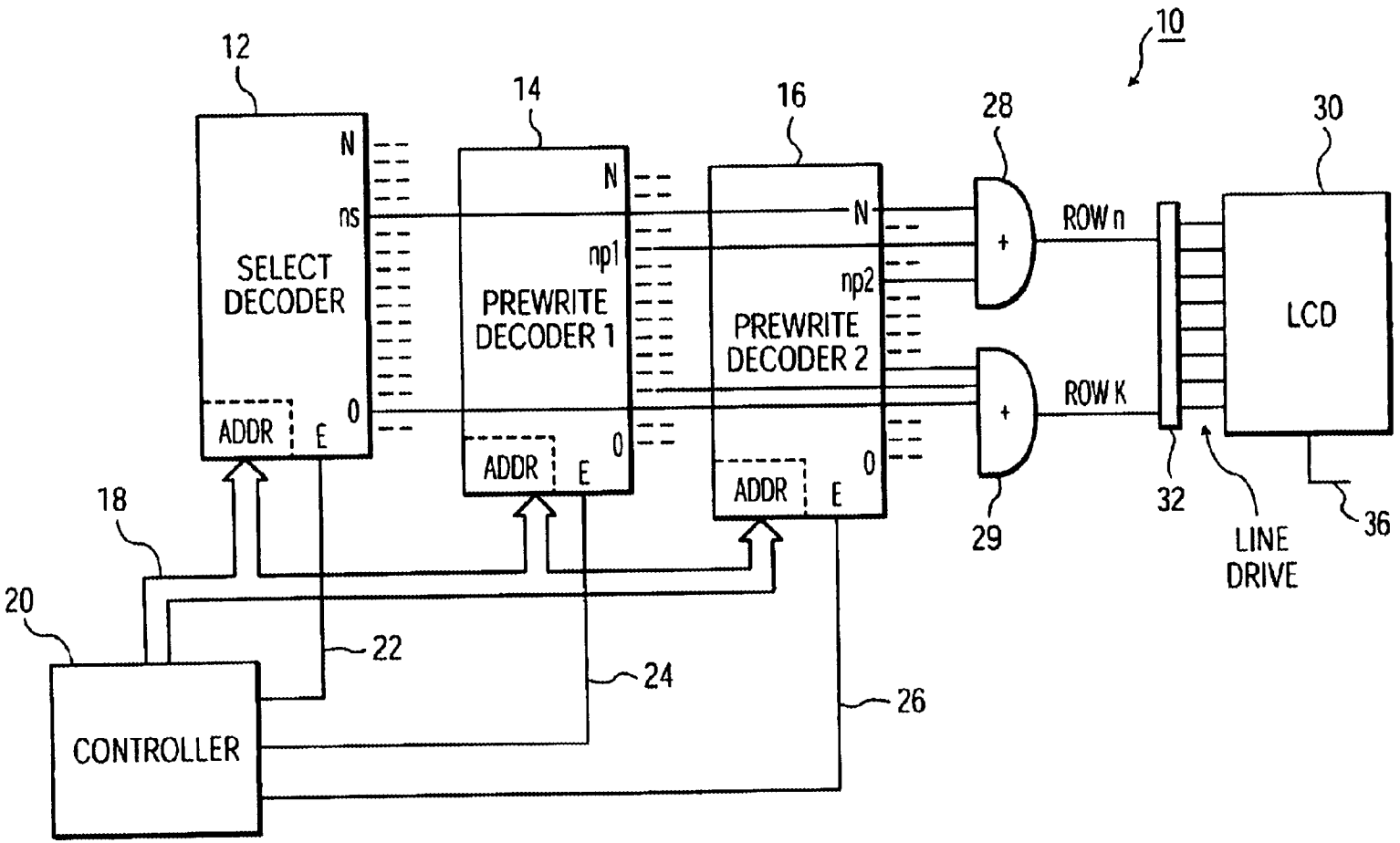
FIG. 1 is a simplified plan view of decoder based row addressing circuitry that implements pre-writes and that is in accord with the principles of the present invention.

Referring to FIG. 1, there is shown a simplified plan view of decoder based row addressing circuitry 10 for a liquid crystal display (LCD) 30 that implements pre-writes and that is in accord with the principles of the present invention. As shown, the addressing circuitry 10 includes a select decoder 12, a first pre-write decoder 14, and preferably a second pre-write decoder 16. It should be understood that one or more physical decoders may be used to implement the decoders 12, 14, and 16.

A controller 20 selectively applies decoder enable signals to the decoders via individual decoder enable lines. A select decoder enable line 22 connects a decoder enable input of the select decoder 12 to the controller 20. A first pre-write decoder output enable line 24 connects a decoder enable input of the first pre-write decoder 14 to the controller 20. A second pre-write decoder enable line 26 connects a decoder enable input of the second pre-write decoder 16 to the controller 20. The controller 20 also selectively supplies address information to the decoders via an address bus 18 shared by all of the decoders. Each address supplied by the controller 20 corresponds to one of a plurality of row enable outputs of each decoder. As shown in FIG. 1, for an LCD 30 with N+1 scanning lines (rows) of pixels, 0 to N, each of the decoders 12, 14, and 16 will have N+1 row enable outputs each providing a row enable signal for a corresponding scanning line (which may be a gate line of a thin film transistor (TFT) if the LCD 30 is a TFT-LCD).

Corresponding row enable signals of each of the decoders are combined together by a combinational logic circuit represented in FIG. 1 by AND gates **28*i* (where $i \epsilon 0,N$) to produce row select signals. By that, it is meant that the $n^{th}$ select row enable signal of the select decoder 12, the $n^{th}$ first pre-write row enable signal of the first pre-write decoder 14, and the $n^{th}$ second pre-write row enable signal of the second pre-write decoder 16 are all applied to the same combinational logic circuit, represented by AND gate 28*n*, to produce a row select signal for row n. It should be understood that in the preferred embodiment, that each row of the LCD 30 has its own combinational logic circuitry (e.g., AND gate 28*i*). Thus, as shown in FIG. 1, for an LCD 30 with N+1 scanning lines (rows), there are N+1 AND gates. Exemplary AND gates 28*n* and 28*k* for rows n and k are shown in FIG. 1**. Additionally, it is understood that the combinational logic function can be implemented in numerous ways, such as by using NAND gates, OR gates, etc., or even by a three-bit-wide look-up table or memory device.

A row select signal output by each AND gate **28*i* is applied to a driver 32, which in turn produces a row drive signal for the corresponding scanning line (row) i of the LCD 30 via a driver 32. Furthermore, it should be understood that a common electrode potential 36 is applied to a common electrode of the LCD display 30. Thus, the addressing of each scanning line (row) of the LCD display 30 is performed by applying the row drive signals of the driver 32 generated in response to the row select signals of the AND gates 28*i*. Each row drive signal controls the switching of all of the switching elements (e.g., TFT devices) in a corresponding row of pixels, allowing image or blanking data to be transferred from data (column) lines of the LCD 30** through the switching elements to pixel electrodes (not shown).

In operation, for each row of pixels of the LCD 30 to be displayed, the row is first selected and all of the pixels of the row are pre-written using a first blanking signal applied via the data lines of the LCD 30. After a predetermined time period (e.g., 25 $\mu$s), the row is selected again, and all of the pixels of the row are again pre-written using a second blanking signal applied via the data lines of the LCD 30. After another predetermined time period (e.g., 100 $\mu$s), the row is selected again and image data is transferred from the data lines to the pixel electrodes to display an image.

Accordingly, to perform a first pre-write operation to provide a first blanking signal to a row n of pixels of the LCD 30, the controller 20 applies a row address for the row n to the address bus 18 and activates a first pre-write decoder address strobe signal for the first pre-write decoder 14. The controller 20 also activates a first pre-write decoder enable signal for the first pre-write enable line 24 connected to the first pre-write decoder 14. The first pre-write decoder 14 decodes the applied row address and, in response to the first pre-write decoder enable signal, activates a first pre-write row enable signal (e.g., active logic LOW) for row n on a row enable output n connected to an input of a corresponding AND gate **28*n*. At this time, the row enable outputs of the select decoder 12 and the second pre-write decoder 16 for the row n are not activated (and thus are logic HIGHs). The AND gate 28*n* then activates a row select signal (logic LOW) for row n which it supplies to the driver 32. The driver 32 turns on the switching devices (e.g., TFTs) of the pixels of row n and, along with the common electrode potential 36** and information applied through the appropriate switching elements, induces first pre-write "blanking pulses" that pre-write the pixels of the selected row n. First blanking information is applied through the switching elements to the individual pixel electrodes via column driver circuitry that is not shown.

After performing the first pre-write operation for row n, the controller 20 deactivates the first pre-write decoder enable signal on the first pre-write enable line 24, and in response thereto the first pre-write decoder 14 deactivates the first pre-write row enable signal for row n. In response to this, the driver 32 turns off the switching devices (e.g., TFTs) of the pixels of row n, and no further data from the column driver circuitry is stored therein.

At a later time (e.g., 25 $\mu$s after the first pre-write to row n), the controller 20 once again applies a row address for row n to the address bus 18 to provide a second blanking signal to the row n of pixels of the LCD 30. However, this time the controller 20 activates a first pre-write decoder address strobe signal for the second pre-write decoder 14 and activates a second pre-write decoder enable signal to the second pre-write decoder enable line 26 connected to the second pre-write decoder 16. The second pre-write decoder 16 decodes the applied row address and, in response to the second pre-write decoder enable signal, activates a second pre-write row enable signal (e.g., active logic LOW) for row n on a row enable output n connected to an input of a corresponding AND gate **28*n*. At this time, the row enable outputs of the select decoder 12 and the first pre-write decoder 14 for the row n are not activated (and thus are logic HIGHs). The AND gate 28*n* then activates a row select signal (logic LOW) for row n which it supplies to the driver 32. The driver 32 turns on the switching devices (e.g., TFTs) of the pixels of row n and, along with the common electrode potential 36** and information applied through the appropriate switching elements, induces second pre-write "blanking pulses" that pre-write the pixels of the selected row n. Second blanking information is applied through the switching elements to the individual pixel electrodes via column driver circuitry that is not shown.

After performing the second pre-write operation for row n, the controller 20 deactivates the first pre-write decoder enable signal on the first pre-write enable line 26, and in response thereto the second pre-write decoder 16 deactivates the second pre-write row enable signal for row n. In response to this, the driver 32 turns off the switching devices (e.g., TFTs) of the pixels of row n, and no further data from the column driver circuitry is stored therein.

Finally, at a subsequent time (e.g., 100 $\mu$s after the second pre-write), the controller 20 applies a row address for row n to the address bus 18 to write image data in the pixels of row n of the LCD 30. This time, the controller 20 activates a select decoder address strobe signal and activates a select decoder enable signal for the select decoder enable line 22 connected to the select decoder 12. The select decoder 12 decodes the applied row address and, in response to the a select decoder enable signal, activates a select row enable signal (e.g., active logic LOW) for row n on a row enable output n connected to an input of a corresponding AND gate 28*n*. At this time, the row enable outputs of the first pre-write decoder 14 and the second pre-write 16 for the row n are not activated (and thus are logic HIGHs). The AND gate 28*n* then activates a row select signal (logic LOW) for row n which it supplies to the driver 32. The driver 32 turns on the switching devices (e.g., TFTs) of the pixels of row n and, along with the common electrode potential 36 and information applied through the appropriate switching elements, induces image data that writes the pixels of the selected row n. Write information is applied through the switching elements to the individual pixel electrodes via column driver circuitry that is not shown.

This process is repeated in each frame such that every row of the LCD 30 is enabled for first and second data pre-write operations and an image data writing operation.

In the preferred embodiment, pre-write and image data writing operations may occur for different rows of the LCD 30 in a same scanning (line) period. For example, the data provided on the column lines during each line interval may comprise an initial blanking voltage, provided during an initial blanking interval of the scanning period, followed by and image data voltage, provided during a subsequent image data writing interval of the scanning period. In that case, while performing a first pre-write operation for the row n, a first part of an image data writing operation may be performed at the same time for a different row k, and, optionally, a second pre-write operation may be preformed for yet a different row m.

In one embodiment of this scheme, the controller 20 writes a first pre-write row address on the address bus 18 and activates a first pre-write decoder address strobe signal for the first pre-write decoder 14. This causes the first pre-write decoder 14 to enable a corresponding row (e.g., row n) of the LCD 30 for a first pre-write operation, as will be explained in more detail below. Next, the controller 20 writes a second blanking row address on the address bus 18 and activates a second pre-write decoder address strobe signal for the second pre-write decoder 16. Then, the controller 20 writes a display row address on the address bus 18 and activates a select decoder address strobe signal for the select decoder 12. The order of writing addresses for the various decoders may be rearranged into any convenient order, and may even be done simultaneously in the case that the address bus 18 is wide enough with a sufficient number of lines. Also, each decoder may have a different address offset so that a single address on the address bus 18 may activate different row enable outputs for each of the decoders.

Next, during the initial blanking interval of the scanning period, the controller 20 activates the first pre-write enable signal for the first pre-writer decoder enable line 24, and also activates the select decoder enable signal for the select decoder enable line 22. In response thereto, as discussed above, the first pre-write decoder 14 activates the first pre-write row enable signal for row n on its row enable output n connected to the AND gate 28*n*. In turn, the AND gate 28*n* activates a row select signal for row n which is supplied to the driver 32, causing the driver 32 to turn on the switching devices of the pixels of row n. At the same time, the select decoder 12 activates the select row enable signal for row k on its row enable output k connected to AND gate 28*k*. In turn, the AND gate 28*k* activates a row select signal for row k which is supplied to the driver 32, causing the driver 32 to also turn on the switching devices of the pixels of row k. Optionally, at the same time the decoder 20 also activates the second pre-write decoder enable signal for the second pre-write enable decoder enable line 26 to thereby turn on the switching devices of the pixels of row m. Thus, during the initial blanking interval of the scanning period, the blanking voltage is provided to the pixels of rows n and k (and optionally row m).

After the initial blanking interval is completed, the controller deactivates the first (and optionally second) pre-write decoder enable signals, causing the driver 32 to turn off the switching devices (e.g., TFTs) of the pixels of row n (and optionally, row m) such that no further data from the column driver circuitry is stored therein. Meanwhile, the switching devices for the pixels of row k remain turned on for the remainder of the scanning period (i.e., during the image data writing interval) to store the desired image data therein.

Advantageously, when first and second pre-write decoders 14 and 16 are included in the row addressing circuitry and when the three decoders are implemented with equivalent circuits, in case one decoder fails there are still two decoders left to support the essential functions of writing data and one pre-write.

While producing both first and second pre-write blanking pulses is useful, the principles of the present invention further provide for bi-directional scanning. In such a mode, the controller 20 applies row address information on the address bus 18 and a decoder enable signal on the enable line 22. The select decoder 12 then decodes the address information and supplies an activated row enable signal to the appropriate AND gate, e.g., AND gate 28*n*, associated with the row address. The gate driver 32 then enables writing of image data into the selected row of pixels. Subsequently, or at the same time, the controller 20 applies an enable signal to another decoder, say to the first pre-write decoder 14, by applying a decoder enable signal to enable line 24. By offsetting the addressed rows (such as by having address n select row n of the select decoder, but select row n+1 of the first pre-write decoder 14), or by the controller 20 applying another row address (say n+1) to the first pre-write decoder 14, the first pre-write decoder decodes the row address and activates a row select signal for its selected AND gate 28(n+1). The AND gate 28(n+1) then applies a logic LOW to the driver 32, which also writes the same image data into the adjacent row. Thus, two lines of the display can show the same information. Then, by blanking the line associated with AND gate 28*n*, the display will appear to scroll. Furthermore, the screen can appear to scroll down (as by applying row n−1 instead of n+1) or can be made to appear to scroll rapidly (such as by applying n+3 instead of n+1). Such a bi-row mode also has other uses, such a rapid screen fills with particular colors, which is easily achieved by not blanking previously written rows (such as row n).

The invention has been described in terms of a limited number of embodiments. Other embodiments, variations of embodiments and art-recognized equivalents will become apparent to those skilled in the art, and are intended to be encompassed within the scope of the invention, as set forth in the appended claims

What we claim is:

1. A row addressing circuit for a liquid crystal display (LCD) device having N+1 rows of pixels, where N is an integer, comprising:

a controller for selectively applying row addresses, and selectively activating a select decoder enable signal, and a first pre-write decoder enable signal;

a select decoder having a first decoder enable input for receiving said selectively activated select decoder enable signal, a select address input for receiving said selectively applied row addresses, and N+1 select row enable outputs, each associated with one of the N+1 rows of pixels and with one of the row addresses, wherein a select row enable signal is produced on one of the select row enable outputs associated with an applied row address when the first pre-write decoder enable signal is activated; and a first pre-write decoder having a second decoder enable input for receiving said selectively activated first pre-write decoder enable signal, a first pre-write address input for receiving said selectively applied row addresses, and N+1 first pre-write row enable outputs, each associated with one of the N+1 rows of pixels and with one of the row addresses, wherein a first pre-write row enable signal is produced on one of the first pre-write row enable outputs associated with an applied row address when the first pre-write enable signal is activated; and N+1 logical combination circuits, each connected to a corresponding one of the select row enable outputs of said select decoder and a corresponding one of the first pre-write row enable outputs of said first pre-write decoder, and producing a row select signal for selecting a predetermined row of pixels among said N+1 rows of pixels.

2. A row addressing circuit according to claim 1, further comprising an address bus connected between the control, the select decoder, and the first pre-write decoder, wherein the controller applies the row addresses onto the address bus.

3. A row addressing circuit according to claim 1, wherein said controller simultaneously activates the select decoder enable signal and the first pre-write decoder enable signal.

4. A row addressing circuit according to claim 1, wherein at a same time while the logical combination circuits produce the row select signal for selecting a predetermined row of pixels among said N+1 rows of pixels, the logical combination circuits also produce a second row select signal for selecting a second predetermined row of pixels among said N+1 rows of pixels.

5. A row addressing circuit according to claim 1, wherein each logical combination circuit provides the row select signal to a row driver for the display device.

6. A row addressing circuit for a liquid crystal display (LCD) device having N+1 rows of pixels, where N is an integer, comprising:

a controller for selectively applying row addresses, and selectively activating a select decoder enable signal, a first pre-write decoder enable signal, and a second pre-write decoder enable signal;

a select decoder having a first decoder enable input for receiving said selectively activated select decoder enable signal, a select address input for receiving said selectively applied row addresses, and N+1 select row enable outputs, each associated with one of the N+1 rows of pixels and with one of the row addresses, wherein a select row enable signal is produced on one of the select row enable outputs associated with an applied row address when the select decoder enable signal is activated; and a first pre-write decoder having a second decoder enable input for receiving said selectively activated first pre-write decoder enable signal, a first pre-write address input for receiving said selectively applied row addresses, and N+1 first pre-write row enable outputs, each associated with one of the N+1 rows of pixels and with one of the row addresses, wherein a first pre-write row enable signal is produced on one of the first pre-write row enable outputs associated with an applied row address when the first pre-write enable signal is activated;

a second pre-write decoder having a third decoder enable input for receiving said selectively activated second pre-write decoder enable signal, a first pre-write address input for receiving said selectively applied row addresses, and N+1 second pre-write row enable outputs, each associated with one of the N+1 rows of pixels and with one of the row addresses, wherein a second pre-write row enable signal is produced on one of the second pre-write row enable outputs associated with an applied row address when the second pre-write decoder enable signal is activated; and N+1 logical combination circuits, each connected to a corresponding one of the select row enable outputs of said select decoder, a corresponding one of the first pre-write row enable outputs of said first pre-write decoder, and a corresponding one of the second pre-write row enable outputs of said second pre-write decoder, and producing a row select signal for selecting a predetermined row of pixels among said N+1 rows of pixels.

7. A row addressing circuit according to claim 6, further comprising an address bus connected between the control, the select decoder, and the first pre-write decoder, wherein the controller applies the row addresses onto the address bus.

8. A row addressing circuit according to claim 6, wherein said controller simultaneously activates the select decoder enable signal and the first pre-write decoder enable signal.

9. A row addressing circuit according to claim 6, wherein said controller simultaneously activates the select decoder enable signal, the first pre-write decoder enable signal, and the second pre-write decoder enable signal.

10. A row addressing circuit according to claim 6, wherein at a same time while the logical combination circuits produce the row select signal for selecting a predetermined row of pixels among said N+1 rows of pixels, the logical combination circuits also produce a second row select signal for selecting a second predetermined row of pixels among said N+1 rows of pixels.

11. A row addressing circuit according to claim 6, wherein each logical combination circuit provides the row select signal to a row driver for the display device.

* * * * *